US006276905B1

(12) United States Patent
Yoshitaka

(10) Patent No.: US 6,276,905 B1
(45) Date of Patent: Aug. 21, 2001

(54) PISTON-SHOE ARRANGEMENT FOR A SWASH PLATE COMPRESSOR

(75) Inventor: Ootsuki Yoshitaka, Gunma (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/459,348

(22) Filed: Dec. 13, 1999

(30) Foreign Application Priority Data

Dec. 14, 1998 (JP) ..... 10-354833

(51) Int. Cl.[7] ..... F04B 1/12
(52) U.S. Cl. ..... 417/269; 74/60; 92/71
(58) Field of Search ..... 417/269; 74/60; 92/71, 129; 71/499

(56) References Cited

U.S. PATENT DOCUMENTS

| | | | | |
|---|---|---|---|---|
| 700,202 | * | 5/1902 | Jaeger | 74/60 |
| 3,958,901 | | 5/1976 | Drevet . | |
| 4,168,632 | | 9/1979 | Fokker . | |
| 4,263,814 | | 4/1981 | Takaoka et al. . | |
| 4,268,225 | | 5/1981 | Nakayama et al. . | |
| 4,329,913 | | 5/1982 | Nakayama et al. . | |
| 4,364,306 | * | 12/1982 | Hattori et al. | 417/269 |
| 4,420,986 | * | 12/1983 | Nakayama et al. | 417/269 |
| 4,522,112 | | 6/1985 | Nomura . | |
| 4,568,252 | | 2/1986 | Hattori et al. . | |
| 4,641,570 | | 2/1987 | Futamura et al. . | |
| 4,662,267 | | 5/1987 | Kaku et al. . | |
| 4,683,804 | * | 8/1987 | Futamura et al. | 417/269 |
| 4,734,014 | * | 3/1988 | Ikeda et al. | 417/269 |
| 4,752,191 | | 6/1988 | Onomura et al. . | |
| 4,781,539 | | 11/1988 | Ikeda et al. . | |
| 4,801,248 | | 3/1996 | Oguru et al. . | |
| 5,483,867 | | 6/1996 | Ikeda et al. . | |
| 5,950,480 | | 9/1999 | Fukushima . | |
| 5,950,521 | | 9/1999 | Fukishima et al. . | |

FOREIGN PATENT DOCUMENTS

| | | |
|---|---|---|
| 11884849 | 2/1959 | (FR) . |
| 49-65509 | 6/1974 | (JP) . |
| 52-169106 | 12/1977 | (JP) . |
| 56-138474 | 10/1981 | (JP) . |
| 61-135990 | 6/1986 | (JP) . |

* cited by examiner

*Primary Examiner*—Charles G. Freay
*Assistant Examiner*—Cheryl J. Tyler
(74) *Attorney, Agent, or Firm*—Baker Botts L.L.P.

(57) ABSTRACT

In a swash-plate type compressor having a shoe interposed between a piston and a swash plate connected to a rotatable shaft, the shoe has a spherical convex part inserted in a concave part of the piston and is slidable along the swash plate. A protrusion is formed in the concave part to leave a clearance between the concave part and the spherical convex part. The shoe converts a rotation of the rotatable shaft to a reciprocating movement of the piston in cooperation with the swash plate.

10 Claims, 2 Drawing Sheets

PISTON-SHOE ARRANGEMENT FOR A SWASH PLATE COMPRESSOR

BACKGROUND OF THE INVENTION

The present invention relates to a swash-plate type compressor and, more particularly, to an engagement structure of a piston and a shoe which are included in the swash-plate type compressor.

Conventional swash-plate type compressors are disclosed in each of Japanese Patent Application Laid-Open Nos. 135990/1986, 65509/1974, and 138474/1981. Each of the swash-plate type compressors comprises a rotatable shaft driven to cause a rotation thereof, a swash plate connected to the rotatable shaft to rotate together with the rotatable shaft, a piston having a concave part facing the swash plate, and a shoe having a spherical convex part inserted in the concave part. When the rotatable shaft rotates, the shoe slides along the swash plate and converts the rotation of the rotatable shaft to a reciprocating movement of the piston in cooperation with the awash plate.

Among these conventional swash-plate type compressors, the compressor using a double-head piston is called a double swash-plate type compressor. The compressor using a piston provided with a compression head only on one end is called a single swash-plate type compressor. In the single swash-plate type compressor, the concave part of the piston is usually made along a single spherical surface having a radius of curvature which is substantially equal to that of the spherical convex part.

During operation of each of the conventional swash-plate type compressors, the shoe performs wobbling movement thereof in the concave part in accordance with the rotating movement of the swash plate. Therefore, the maintaining of excellent lubricating properties is demanded between the spherical convex part of the shoe and the concave part of the piston.

However, the swash-plate type compressor in previous technique has disadvantages in that lubricant oil cannot easily enter between the concave part of the piston and the spherical convex part of the shoe. This is because the concave part of the piston substantially coincides with the spherical convex part of the shoe, there is little clearance between both sliding surfaces.

Therefore, a large force acts on the concave part of the piston, thereby generating wear by sliding movement with the shoe. Particularly in the initial stage of operation of the swash-plate type compressor, since the concave part does not sufficiently fit with the spherical convex surface of the shoe, wear amount is considerable. Moreover, an abnormal wear is sometimes generated in the concave part of the piston.

To prevent this, it is described, for example, in U.S. Pat. No. 4,734,014 that the convex curved surface of the shoe is formed into a spherical surface having a smaller curvature radius than that of the spherical surface of the concave part and that the vertex of the spherical curved surface is formed into a flat part. In the compressor described in this U.S. patent, an oil reservoir is formed between the flat part of the shoe and the accomodation concave part, which is advantage for the lubricating properties.

However, when the end of the flat surface of the shoe slides on the inner surface of the concave part, the local wear of the concave part is more promoted. Therefore, a clearance is generated in a part different from the clearance disposed beforehand. In addition, the load of the local force causes partial deformation in the concave part. So that, the life of the compressor is shortened. Additionally, as a result of reinforcement of relative vibration of the shoe, the generation of noise during the operation is also promoted.

SUMMARY OF THE INVENTION

It is therefore an object of the present invention to provide a swash-plate type compressor in which local wear or partial deformation is not caused in the concave portion although lubricant oil is readily introduced between a concave portion of a piston and a spherical convex portion of a shoe in an initial stage of the compressor and which.

It is another object of the present invention to provide an engagement structure between the piston and the shoe in the swash-plate type compressor, in which wear is promoted without dragging or tearing to thereby make the concave part of the piston fit to the spherical convex portion of the shoe.

Other objects of the present invention will become clear as the description proceeds.

According to an aspect of the present invention, there is provided a swash-plate type compressor which comprises a rotatable shaft driven to cause a rotation thereof, a swash plate connected to the rotatable shaft to rotate together with the rotatable shaft, a piston having a concave part facing the swash plate, and a shoe having a spherical convex part inserted in the concave part. The shoe is slidable along the awash plate for converting the rotation of the rotatable shaft to a reciprocating movement of the piston in cooperation with the swash plate. The piston further has a protrusion formed in the concave part to leave a clearance between the concave part and the spherical convex part.

It may be arranged that the protrusion is formed at a bottom of the concave part.

It may be arranged that the concave part has at least two spherical surfaces which partially superpose to each other to form the protrusion between adjacent ones of the spherical surfaces.

It may be arranged that the piston has a pair of opposite surfaces defining a groove therebetween, the concave part being formed in one of the opposite surfaces, the awash plate having a peripheral portion inserted in the groove.

It may be arranged that another of the opposite surfaces is formed with an additional concave part, the compressor further comprising an additional shoe having a spherical convex part inserted in the additional concave part, the additional shoe being slidable along the swash plate for converting the rotation of the rotatable shaft to the reciprocating movement of the piston in cooperation with the swash plate and the first-mentioned shoe.

It may be arranged that the piston further has an additional protrusion formed in the additional concave part to leave a clearance between the additional concave part and the spherical convex part of the additional shoe.

It may be arranged that the additional protrusion is formed at a bottom of the additional concave part.

It may be arranged that the additional concave part has at least two spherical surfaces which partially superpose to each other to form the protrusion between adjacent ones of the spherical surfaces.

According to another aspect of the present invention, there is provided a piston and shoe engagement structure of a swash-plate type compressor provided with a swash plate for rotating around a rotatable shaft and performing reciprocating movement along the rotatable shaft, and a piston having a groove for passing the swash plate to convert the movement of the swash plate to the reciprocating movement via a shoe, wherein end surfaces of the groove are provided with concave parts having circular surface shapes to hold a spherical surface part of the shoe, the each of concave parts having a bottom part provided with a convex part.

It may be arranged that, by superposing at least two spherical surfaces different in central position, the convex part is formed in a boundary part between the spherical surfaces.

DESCRIPTION OF THE PREFERRED EMBODIMENTS

Figure 1:
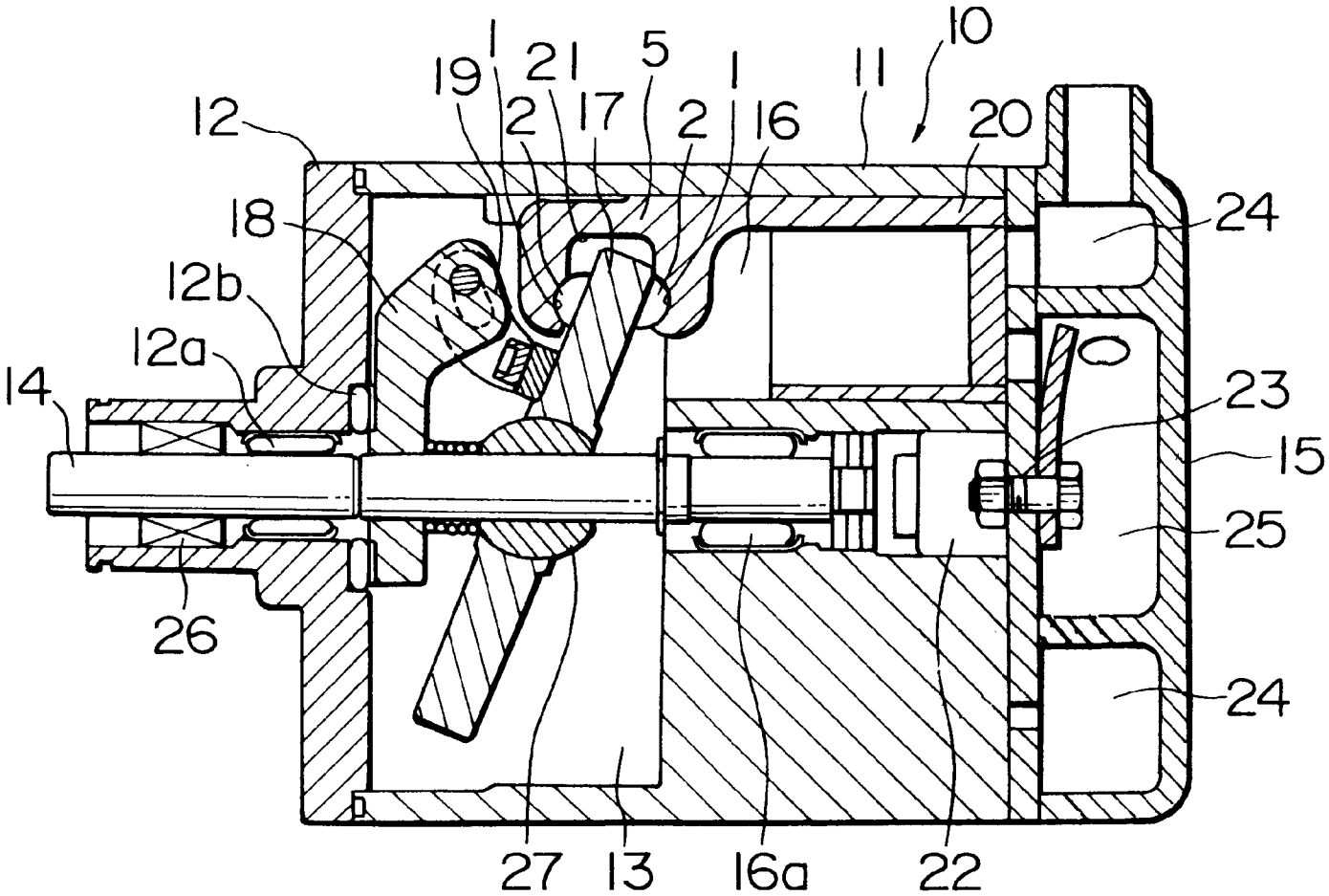
FIG. 1 is a longitudinal sectional view of a swash-plate type compressor according to an embodiment of the present invention.

With reference to the drawing, description will be made hereinafter as regards a swash-plate type compressor according to an embodiment of the present invention.

Referring to FIG. 1, the swash-plate type compressor 10 is also called a single swash-plate type compressor and usable in an air conditioner for an automobile. The swash-plate type compressor 10 includes a cylinder block 11 integrally formed with a housing having an opening on one end thereof, a front housing 12 disposed to cover the opening of the housing, and a cylinder head 15 disposed to close the other end of the cylinder block 11 via a valve plate device 23, so that the entire outer contour is formed. The cylinder block 11 has a plurality of cylinder bores 16 constituted of through holes passing from one end toward the other end. The cylinder bores 16 are formed in equiangular positions on a circumference. A discharge chamber 25 and a suction chamber 24 are divided/formed by the walls of the valve plate device 23 and the cylinder head 15.

A crank chamber 13 is defined inside by the cylinder block 11 and the front housing 12. A rotatable shaft 14 is extended through the crank chamber 13 from a protruding part of front housing 12 to the cylinder block 11 in an axial direction. The rotatable shaft 14 is rotatably supported by the front housing 12 and the cylinder block 11 via bearings 12*a*, 16*a*. An automobile engine (not shown) rotates the rotatable shaft 14 for driving the swash-plate type compressor. Additionally, a reference numeral 26 denotes a seal member for shielding the shaft from the outside.

A spherical support member 27 is fitted over the rotatable shaft 14 to be slidable along the rotatable shaft 14 in the axial direction. A swash plate 17 is disposed around the rotatable shaft 14 in the crank chamber 13 and supported on the spherical support member 27 to be capable of sliding along or wobbling around the spherical support member 27. A rotor 18 is fixed to the rotatable shaft 14. One end of the rotor 18 is supported by the inner wall of the front housing 12 via a bearing 12*b*. The other end of the rotor 18 is connected to the swash plate 17 through a connecting part or hinge mechanism 19.

Furthermore, a plurality of pistons 20 are inserted in the cylinder bores 16, respectively. Each of the pistons 20 is slidable in the axial direction and includes a neck portion 5 having a pair of opposite surfaces which are define a groove 21 therebetween. The swash plate 17 has a peripheral portion that is inserted in the groove 21. A pair of concave parts 1 is formed to the opposite surfaces of the neck portion 5. The concave parts 1 are opposite to each other in the axial direction.

Hemispherical shoes 2 are interposed between the concave parts 1 and the swash plate 17. Each of the shoes 2 is fitted in each of the concave parts 1 in the manner which will later be described in detail.

A pressure control device 22 is disposed for adjusting a pressure in the crank chamber 13. In response to the pressure of the crank chamber 13, the swash plate 17 has an inclined angle adjusted with respect to the rotatable shaft 14 in the manner known in the art. The swash-plate type compressor has a compression capacity determined in accordance with the inclined angle of the swash plate 17.

When the automobile engine rotates the rotatable shaft 14, the swash plate 17 is rotated together with the rotatable shaft 14 through the rotor 18 and the hinge mechanism 19. As a result, the peripheral part of the swash plate 17 performs movement in a circular arc shape along the rotatable shaft 14 centering on the center part on the rotatable shaft 14.

With the rotation of the swash plate 17, the piston 20 is alternately pressed back and forth via the shoes 2 to reciprocate/slide in the cylinder bore 16. Fluid is drawn between the inside of a suction valve cylinder bore (not shown) and the head of the piston 20 from the suction chamber 24 by the reciprocating movement of the piston 20, and is then discharged to the discharge chamber 25 via a discharge valve by the movement of the piston 20 toward the right as seen in FIG. 1.

Figure 2:
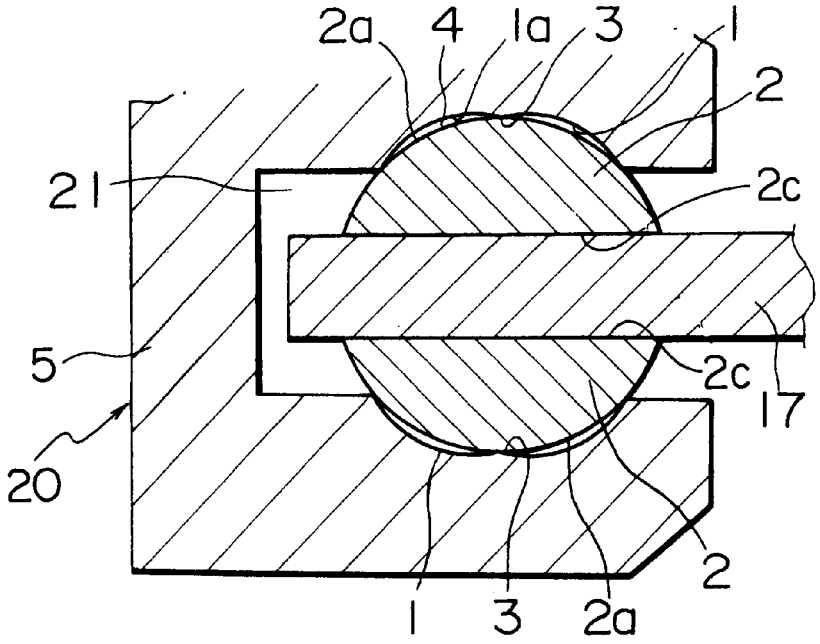
FIG. 2 is an enlarged sectional view of a main portion of the swash-plate type compressor of FIG. 1.

Referring to FIG. 2, the peripheral portion of the awash plate 17 is inserted or accomodated in the groove 21 in the neck portion 5 of the piston 20. The shoes 2 are interposed between the concave parts and the swash plate 17, respectively. Each of the shoes 2 has a spherical convex part 2*a* and a flat surface. The spherical convex part 2*a* is in sliding contact with the corresponding concave part 1*a*. The flat surface 2*c* is in sliding contact with the peripheral portion of the swash plate 17. It is to be noted here that each of the concave parts 1 has a protrusion 3 in its center part.

Figure 3:
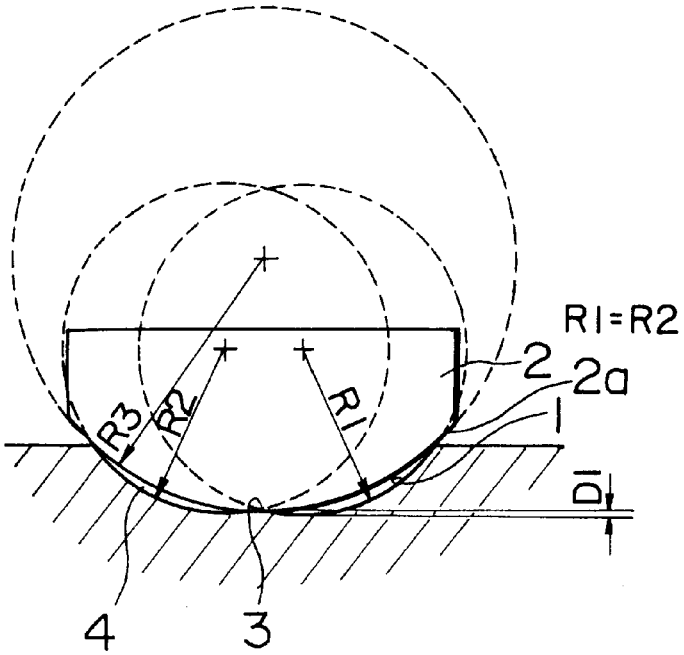
FIG. 3 is a schematic sectional view for describing in detail the main portion of FIG. 2.

Referring to FIG. 3, each of the concave parts 1 is constituted of a first spherical surface having a radius R1 and a second spherical surface having a radius R2. The first and the second spherical surfaces have centers of curvature spaced to each other and partially superpose to each other to form the protrusion 3 therebetween. In this connection, the radii R1 and R2 are determined equal to each other. Additionally, FIG. 3 shows an example in which each of the radii R1 and R2 is determined to be smaller than a radius R3 of the spherical convex part 2*a* of the shoe 2. It is preferable that the protrusion 3 has a height D1 of about 1 to 20 $\mu$m.

Turning back to FIG. 2, by the shape relation between the spherical convex part 2*a* of the 2 and the concave part 1 the piston 20, a clearance 4 is formed therebetween. This enables refrigerant gas to easily enter the clearance 4. As a result, mist-state lubricant oil in the gas goes even into the bottom part of the concave part 1 which is the receiving seat. Therefore, since the lubricant oil is present on the sliding surface in the initial stage, wear is generated without dragging or tearing.

As described above, the protrusion 3 provides an effective fitting property of the shoe 2 and the concave part 1 as a shoe receiving seat. In other words, the shoe 2 appropriately wears because of the concave part 1 as the shoe receiving seat. As a result, the durability of the compressor is enhanced.

While the present invention has thus far been described in connection with a single embodiment thereof, it will readily be possible for those skilled in the art to put this invention into practice in various other manners. For example, the concave part of the piston may be constituted of three or more spherical surfaces, adjacent ones of which are partially superposed to each other. It is a matter of course that the protrusion can be formed in the various manner known in the art.

What is claimed is:

1. A swash-plate type compressor comprising:

a rotatable shaft driven to be caused a rotation thereof;

a swash plate connected to said rotatable shaft to rotate together with said rotatable shaft;

a piston having a concave part facing said swash plate; and a shoe having a spherical convex part inserted in said concave part, said shoe being slidable along said swash plate for converting said rotation of the rotatable shaft to a reciprocating movement of said piston in cooperation with said swash plate, said piston further having a protrusion formed in a center part of said concave part to leave a clearance between said concave part and said spherical convex part.

2. A swash-plate type compressor as claimed in claim 1, wherein said protrusion is formed at a bottom of said concave part.

3. A swash-plate type compressor as claimed in claim 1, wherein said concave part has at least two spherical surfaces which partially superpose to each other to form said protrusion between adjacent ones of said spherical surfaces.

4. A swash-plate type compressor as claimed in claim 1, wherein said piston has a pair of opposite surfaces defining a groove therebetween, said concave part being formed in one of said opposite surfaces, said swash plate having a peripheral portion inserted in said groove.

5. A swash-plate type compressor as claimed in claim 4, wherein another of said opposite surfaces is formed with an additional concave part, said compressor further comprising an additional shoe having a spherical convex part inserted in said additional concave part, said additional shoe being slidable along said swash plate for converting said rotation of the rotatable shaft to said reciprocating movement of the piston in cooperation with said swash plate and the first-mentioned shoe.

6. A swash-plate type compressor as claimed in claim 5, wherein said piston further has an additional protrusion formed in said additional concave part to leave a clearance between said additional concave part and said spherical convex part of the additional shoe.

7. A swash-plate type compressor as claimed in claim 6, wherein said additional protrusion is formed at a bottom of said additional concave part.

8. A swash-plate type compressor as claimed in claim 6, wherein said additional concave part has at least two spherical surfaces which partially superpose to each other to form said protrusion between adjacent ones of said spherical surfaces.

9. A piston and shoe engagement structure of a swash-plate type compressor provided with a swash plate for rotating around a rotatable shaft and performing reciprocating movement along said rotatable shaft, and a piston having a groove for passing said swash plate to convert the movement of said swash plate to the reciprocating movement via a shoe, wherein end surfaces of said groove are provided with concave parts having circular surface shapes to hold a spherical surface part of said shoe, said each of concave parts having a bottom part provided with a convex part a central portion thereof.

10. A piston and shoe engagement structure as claimed in claim 9, wherein, by superposing at least two spherical surfaces different in central position, said convex part is formed in a boundary part between said spherical surfaces.

* * * * *